US006444914B1

(12) United States Patent
Su

(10) Patent No.: US 6,444,914 B1
(45) Date of Patent: Sep. 3, 2002

(54) CLAMPING DEVICE FOR SIGNAL WIRES

(75) Inventor: Kuo-Tai Su, Yung Kang (TW)

(73) Assignee: Thunderbolt Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 09/866,613

(22) Filed: May 30, 2001

(51) Int. Cl.[7] ..... H01R 4/00
(52) U.S. Cl. ..... 174/84 R; 174/845; 174/93
(58) Field of Search ..... 174/88, 74 R, 174/77 R, 84 R, 89, 92, 93, 94 S

(56) References Cited

U.S. PATENT DOCUMENTS 457,865 A * 8/1891 Manson
3,401,371 A * 9/1968 Hammond ..... 339/268
3,695,642 A * 10/1972 DeWoody ..... 285/133 R
3,854,003 A * 12/1974 Duret ..... 174/88 C
5,548,088 A * 8/1996 Gray et al. ..... 174/74 R
5,683,273 A * 11/1997 Garver et al. ..... 439/784
5,760,332 A * 6/1998 Rocci et al. ..... 174/84 R
6,069,320 A * 5/2000 Rocci et al. ..... 174/84 R

* cited by examiner

*Primary Examiner*—Dean A. Reichard
*Assistant Examiner*—William H. Mayo III
(74) *Attorney, Agent, or Firm*—Rosenberg, Klein & Lee

(57) ABSTRACT

A clamping device for signal wires has a main body having a central through holes. A set of signal wires covered in a common plastic tube is passed through the main body. The end portions of the common plastic tube are cut off for the signal wires to pass through a respective one of through holes of a locating body secured between a front end of the main body and a front ring screwed onto the main body. The main body has a connecting portion that has several connecting plates on rear part for the common tube end portion to be secured in it by screwing a rear ring onto the main body rear part to press the connecting plates inwardly of the main body. The main body further has ornamental annular protrusions on the outer side, and the rear and the front rings have tapered outer sides.

2 Claims, 5 Drawing Sheets

CLAMPING DEVICE FOR SIGNAL WIRES

BACKGROUND OF THE INVENTION

The present invention relates to a clamping device for signal wires, and particularly to one which can locate each of the signal wires in a proper position to prevent same from getting entangled with each other or parted from each other too much.

Signal wires are used in both video and audio systems such as television and radio for transmitting images and sounds. Such signal wires usually have several independent wires each covered in a respectively plastic tube, and all of the wires are covered in a main plastic tube.

Referring to FIG. 6, for connection of the wires to the video or audio system, the main plastic tube is cut off from the end portions such that the independent wires can be exposed to outside.

Referring to FIG. 7, a conventional clamping device is fitted onto the wires and the end of the main plastic tube to confine the wires, and make the joint between the wires and the main plastic tube look more pleasant.

However, it is found that the conventional clamping device itself is not good-looking enough when compared with the high-class audio/video equipment to which the signal wires are connected. Consequently, the signal wires are likely to become the most unpleasant-looking part of the video/audio systems.

SUMMARY OF THE INVENTION

Therefore, it is a main object of the present invention to provide a clamping device for signal wires, which can locate the wires in proper positions as well as make the joint between the wires and the main plastic covering look more pleasant.

The clamping device for signal wires of the present invention includes a rear ring, a main body, a locating part and a front ring. The rear ring has a threaded portion on an inner side. The main body has a central through hole for a set of signal wires having a main plastic covering tube to pass through; the covering tube is secured to a connecting portion consisting of several separate connecting plates at rear part of the main body with the rear ring being screwed onto the main body to press the connecting portion inwardly of the main body.

The wires are passed through a respective one of through holes of the locating part, which is secured to a front end of the main body by means of the front ring screwed onto a front end portion of the main body; the front ring has an annular stopping protrusion on a front end of the inner side for preventing the locating part from falling out.

The main body further has several ornamental annular protrusions on the outer side, and the front ring and the rear ring have tapered outer sides for the clamping device to be in harmony with the video/audio equipment, to which the signal wires are connected.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
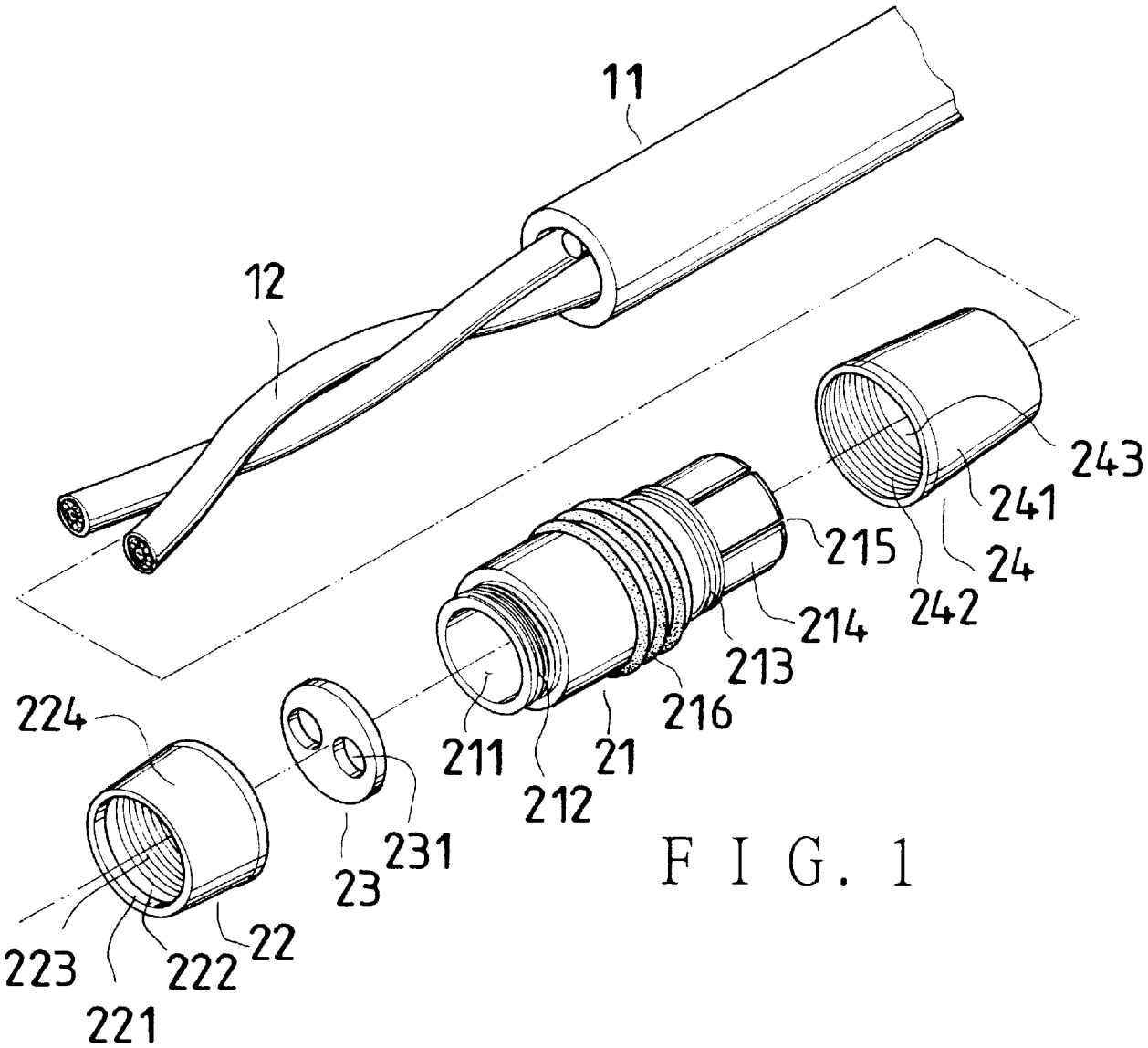
FIG. 1 is an exploded perspective view of the clamping device for signal wires according to the present invention.

Referring to FIG. 1, a clamping device for signal wires of the present invention has a main body 21, a front ring 22, a locating part 23 and a rear ring 24.

Figure 2:
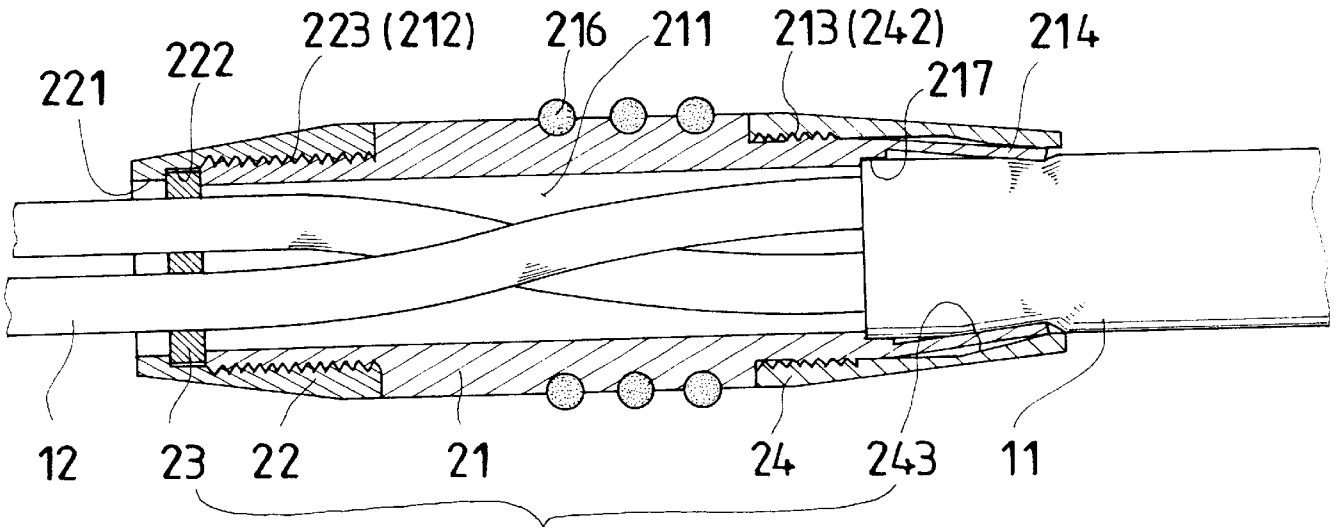
FIG. 2 is a cross-sectional view of the clamping device for signal wires in FIG. 1.

The main body 21 has a central through hole 211, a threaded end portion 212 on an outer side of the front portion, a threaded portion 213 on an outer side near the rear end and a connecting portion 214 at the rear end. The connecting portion 214 consists of several connecting plates 215 having spaces provided between every two adjacent ones. The main body 21 further has ornamental annular protrusions 216 on an intermediate portion of an outer side. Referring to FIG. 2, the main body 21 further has an annular stopping step 217 on the inner side near the connecting portion 214.

The front ring 22 has an annular protrusion 221 on a front end of the inner side, a receiving recess 222 next to the annular stopping protrusion 221, and a threaded portion 223 on the inner side. The front ring 22 further has an outer side 224, which is preferably made to have a tapered shape.

The locating part 23 is shaped such that it can be fitted onto the receiving recess 222 of the front ring 22 with the annular stopping protrusion 221 of the front ring 22 preventing same from falling out. The locating part 23 has through holes 231 slightly bigger than the separate signal wires 12 for wires 12 to pass through.

The rear ring 24 has a threaded portion 242 on a front portion of the inner side and an outer side 241, which is preferably made to have a tapered shape. The rear ring 24 has an inner sloping side 243 (FIG. 2) on a rear portions.

To use the clamping device on signal wires, the wires 12, with a front end portion of the main plastic covering tube 11 being cut off, are passed through the rear ring 24, the main body 21, the locating part 23 and the front ring 22 in order; the signal wires 12 are passed through a respective one of the through holes 231 of the locating part 23; the front end of the main plastic covering tube 11 is stopped from moving forwards by the inner annular stopping step 217(Fig. 2). The rear ring 24 is screwed onto the threaded portion 213 to connect the main body 21; the inner sloping side 243 of the rear ring 24 presses the connecting plates 215 of the connecting portion 214 inwardly of the main body 21 such that the connecting plates are secured to the plastic parts of the wires 12. The front ring 22 is screwed onto the threaded end portion 212 to connect the main body 21 with the locating part 23 being fixed between the stopping protrusion 221 of the front ring 22 and the front end of the main body 21.

Thus, the signal wires 12 are located such that they are not likely to get entangled or parted from each other. And, because the joint between the wires 12 and the main plastic covering tube 11 is covered by the clamping device, the signal wires have a more pleasant appearance, especially with the ornamental annular protrusions 216.

Figure 3:
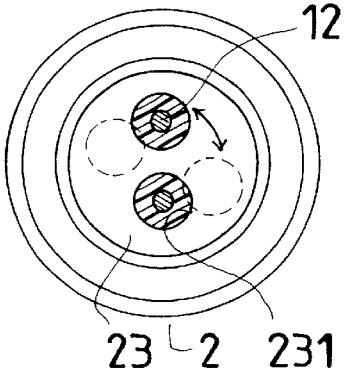
FIG. 3 is a side view of the clamping device for signal wires of the present invention.
Figure 4:
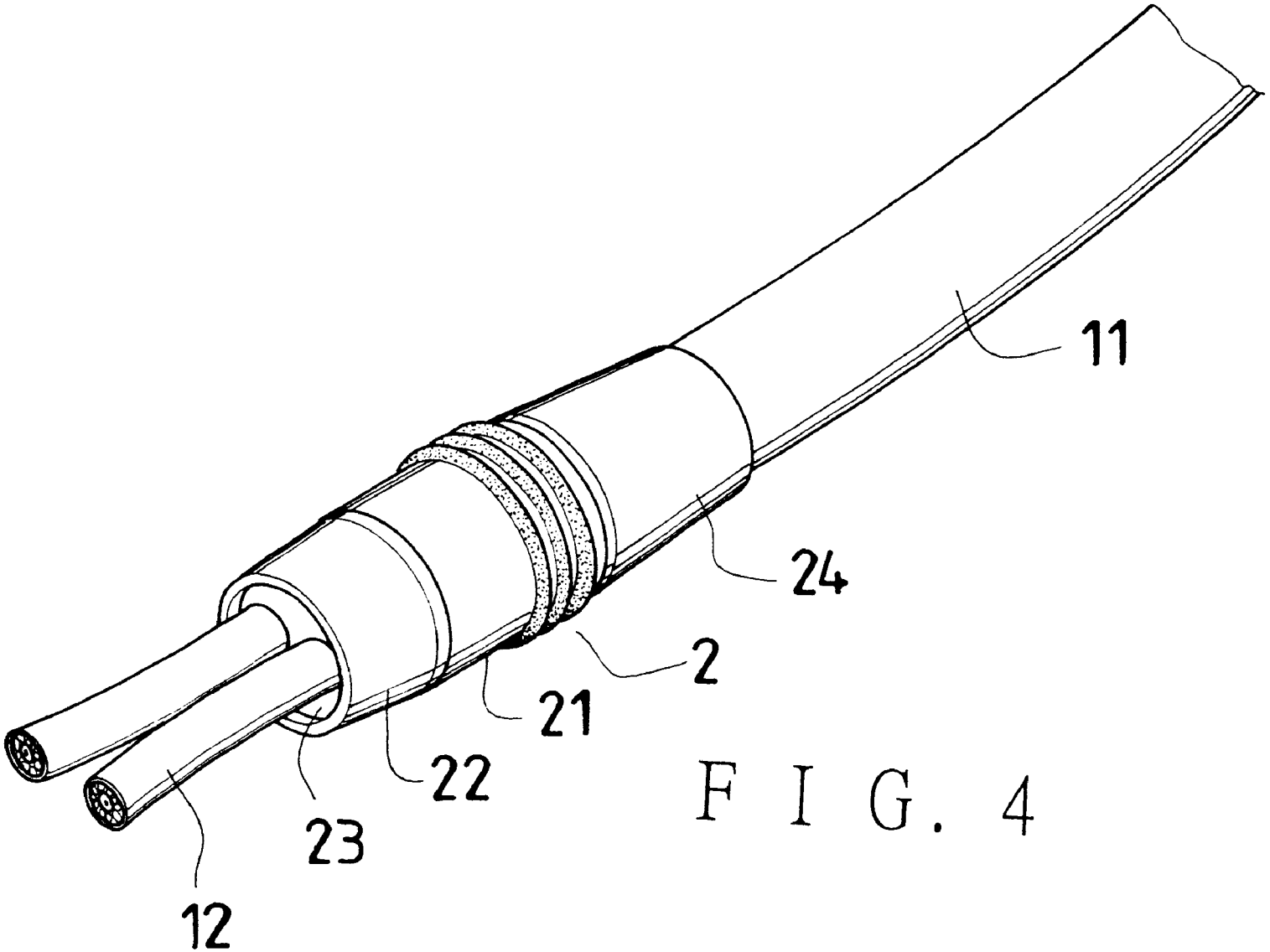
FIG. 4 is a perspective view of the clamping device for signal wires of the present invention being used on a set of signal wires.

Referring to FIG. 3, the locating part 23 can be turned inside the front ring 22 for the wires 12 to be moved to appropriate positions.

Figure 5:
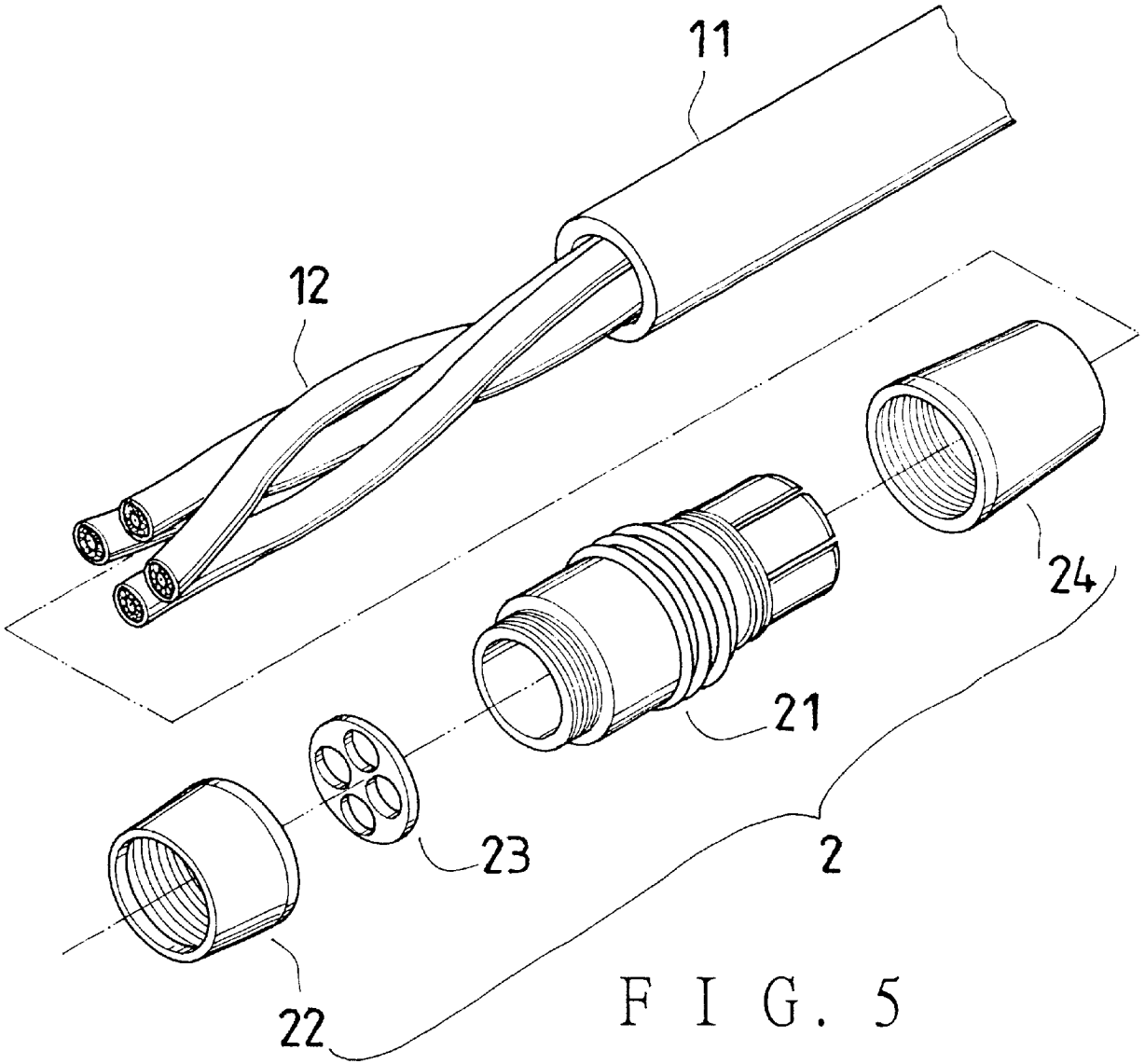
FIG. 5 is an exploded perspective view of the clamping device for signal wires according to the second embodiment of the present invention.
Figure 7:
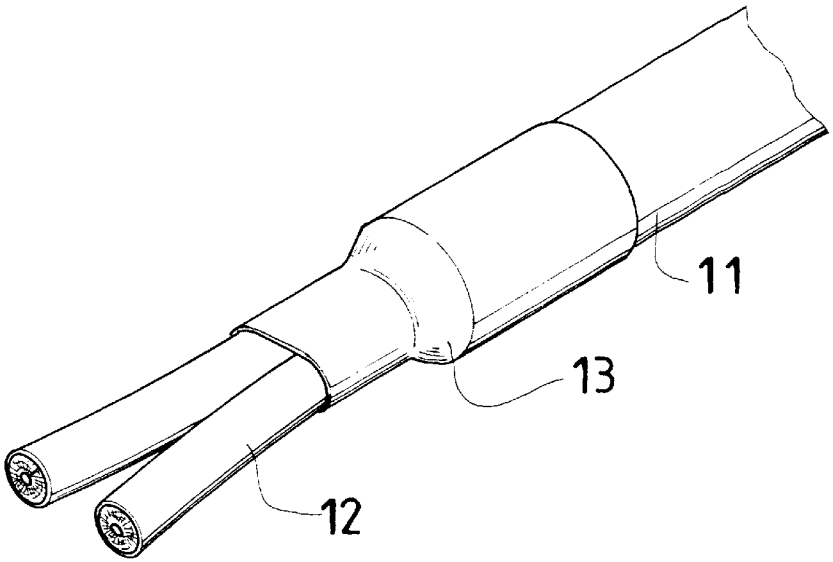
FIG. 7 (PRIOR ART)
FIG. 7 is a perspective view of the conventional clamping device for signal wires in the Background.
Figure 6:
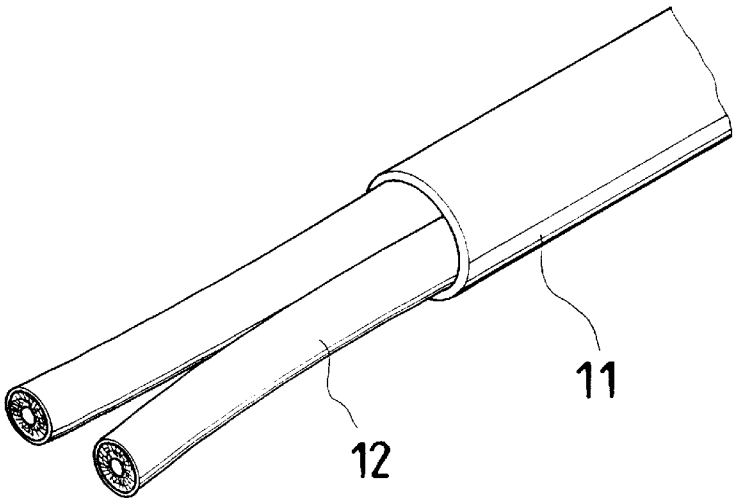
FIG. 6 (PRIOR ART)
FIG. 6 is a perspective view of a set of signal wires.

Referring to FIG. 5, in a second embodiment of the present invention, a locating part 23 with four through holes can be used on a signal wire set of four wires.

From the above description, the clamping device for signal wires of the present invention can be known to have desirable features as follows:

1. It looks pleasant, and can be in harmony with the audio/video equipment.
2. The locating part can prevent the signal wires from getting entangled.
3. The locating part is turnable for providing the signal wires with room of movement.
4. The clamping device can be used in various sets of different numbers of wires when a locating part having a suitable number of through holes is provided.

What is claimed is:

1. A clamping device for signal wires, comprising:

a set of signal wires having a main covering tube;

a rear ring having a threaded portion on an inner side thereof and a sloping inner wall extending from said threaded portion;

a main body having a central through bore for said set of signal wires to pass therethrough, said main body having a plurality of connecting plates formed on a rear end thereof and a first threaded portion adjacent thereto, said plurality of connecting plates clampingly engaging said main covering tube to secure said set of signal wires responsive to said rear ring being threadedly engaged with said first threaded portion of said main body, said main body having a front end with a second threaded portion formed thereon;

a locating part disposed contiguous an outer edge of said front end of said main body and having a plurality of holes formed therethrough for individual wires of said set of signal wires being respectively passed therethrough; and, a front ring having (a) an annular protrusion extending from an internal surface thereof adjacent to an end of said front ring, (b) an annular recess formed in said internal surface adjacent to said annular protrusion for receiving said locating part therein, and (c) a threaded portion formed in said internal surface and extending from said annular recess to an opposing end of said front ring, said front ring being threadedly engaged with said second threaded portion of said main body for capturing said locating part between said outer edge of said front end of said main body and said annular protrusion.

2. The clamping device for signal wires as claimed in claim 1, wherein said main body has an annular stopping step formed in an inner surface thereof for blocking a front edge of said main covering tube and thereby limiting an insertion depth of said set of signal wires within said main body.

* * * * *